United States Patent [19]

Dao

[11] Patent Number: 4,487,159

[45] Date of Patent: Dec. 11, 1984

[54] PLATING BARREL

[75] Inventor: Hoa T. Dao, Elizabeth, N.J.

[73] Assignee: OMI International Corporation, Warren, Mich.

[21] Appl. No.: 448,567

[22] Filed: Dec. 15, 1982

[51] Int. Cl.[3] ..... B05C 3/08

[52] U.S. Cl. ..... 118/418; 204/213

[58] Field of Search ..... 118/418, 19; 427/242; 204/213, 214; 366/234; 69/30

[56] References Cited

FOREIGN PATENT DOCUMENTS 417537 7/1974 U.S.S.R. ..... 118/418

*Primary Examiner*—Evan K. Lawrence

*Attorney, Agent, or Firm*—Richard P. Mueller

[57] ABSTRACT

A plating barrel is constructed of a perforated cylindrical side section clamped between a pair of end plates. The end plates are provided with positioning grooves that receive edge portions of the side section. Each end plate includes a plurality of concentric grooves so that the same end plates may be used with side sections of different diameters. The barrel is rotatably mounted on a support disposed within a seamless tank containing a plating bath. The support has adjustable upstanding arms which rotatably support the barrel and permit the height thereof to be adjusted for controlling the extent to which the barrel is immersed in the plating bath, with such adjustment being dictated in part by the extent of the areas to be plated and the number of work pieces in the barrel.

7 Claims, 4 Drawing Figures

PLATING BARREL

This invention relates generally to apparatus for metal plating processes and more particularly relates to the construction of a perforated rotatable barrel used for electroless plating.

So-called electroless processes for the metal plating of large batches of small parts that vary in size are often carried out by utilizing a barrel or cylinder that is rotated about its cylindrical axis which is positioned horizontally. Barrels of this type are illustrated in U.S. Pat. Nos. 1,251,568, 1,376,052 and 3,861,654.

One such electroless plating process is utilized to plate discrete surface areas of ceramic elements with gold requires a strongly alkaline solution with a pH in the range of 13 to 14. This solution is very sensitive to localized hot spots and bath stability with respect to metallic impurities for nickel and iron are 50 parts per million. In order to obtain a stable bath and good deposition rate, temperature must be maintained at $82 \pm 1°$ C. The ceramic parts being plated typically vary in size from $\frac{1}{2}$ to $1\frac{1}{2}$ inches in width by 1/100 to 1/16 inch thick.

The barrels in question are usually constructed of metal, typically stainless steel, and include welded joints that corrode. This corrosion causes the gold bath to decompose prematurely.

In accordance with the instant invention, the barrel is disposed within a seamless tank and corrosion at the barrel joints is eliminated by clamping the cylindrical side section of the barrel between end plates so that it is not necessary to have welds at the interfaces between the side section and end plates.

This concept of clamping the cylindrical section between the end plates permits different diameter cylindrical sections to be utilized with the same end plates. To facilitate this interchangeability, the end plates are provided with a plurality of concentric grooves that receive the ends of the cylindrical sections. The size of the barrel cylinder or side section being utilized depends upon the quantity of partes and the sizes of the areas being plated. Tie rods, through which clamping forces are applied to the end plates, are positioned adjacent the inner surface of the cylindrical side section to facilitate tumbling of the parts being plated.

For the larger size barrel, holes provided in the end plates for tie rods that are not required may be utilized for securement of so-called buffer or scrubber rods.

Accordingly, the primary object of the instant invention is to provide a novel construction for a plating barrel.

Another object is to provide a plating barrel having reduced susceptibility to corrosion.

Still another object is to provide a plating barrel constructed so that a single set of end plates may be utilized with different diameter tubular side structures.

A further object is to provide a plating barrel construction in which the tubular side wall is clamped between a pair of spaced end walls.

A still further object is to provide a plating barrel with a support that is adjustable so that barrel height may be set in relation to depth of the plating bath.

These objects as well as other objects of this invention shall become readily apparent after reading the following description of the accompanying drawings, in which.

Figure 1:
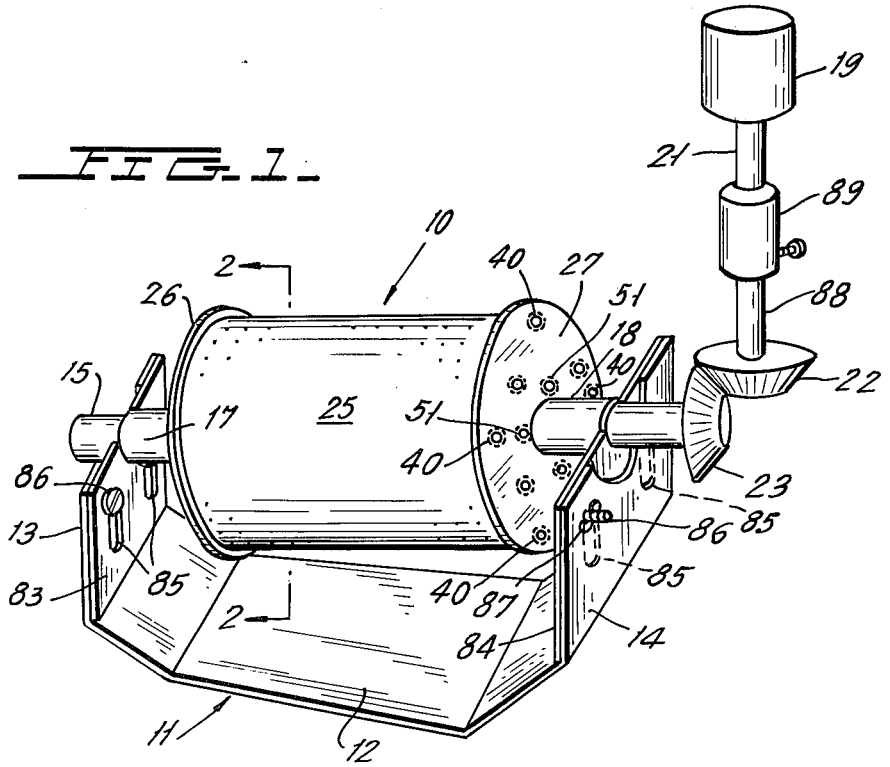
FIG. 1 is a perspective of a plating barrel and barrel support constructed in accordance with teachings of the instant invention.
Figure 2:
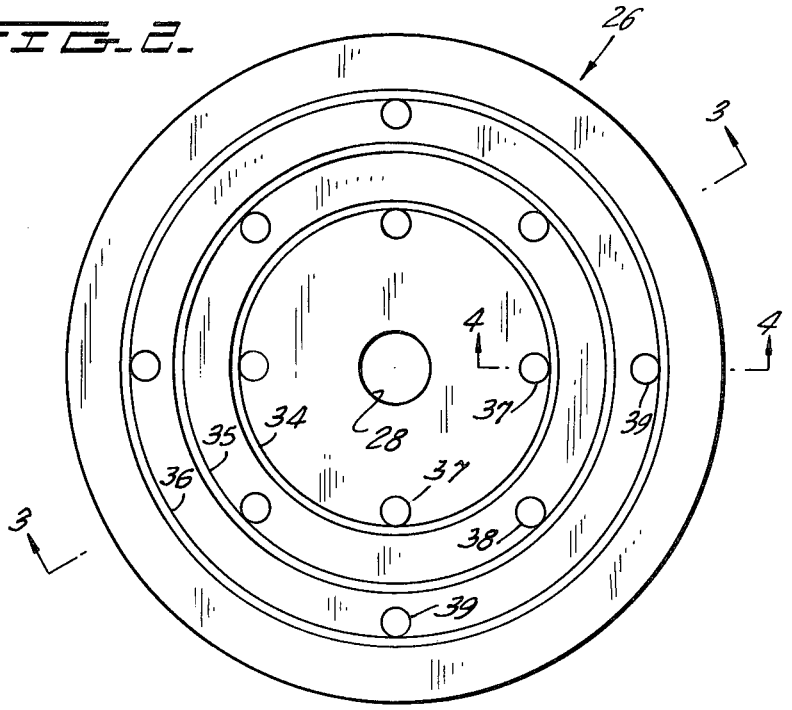
FIG. 2 is a side elevation of one of the end plates looking in the direction of arrows 2—2 of FIG. 1.

Now referring to the Figures. In FIG. 1, plating barrel 10, constructed in accordance with the instant invention, is illustrated as being rotatably supported on generally U-shaped stand 11 that rests on the bottom of a seamless tank (not shown) containing a bath of plating solution. That is, stand 11 includes horizontal web 12 and upwardly extending spaced arms 13, 14. Teflon plates 83, 84 are mounted to the respective arms 13, 14 so as to be slidably movable along the inboard surfaces thereof. Each of the plates 83, 84 is provided with a pair of spaced parallel vertical slots 85, 85 through which an individual screw 86 extends after passing through a clearance aperture in arms 13 or 14. The free ends of screws 86 are threadably engaged by wing nuts 87 that act to clamp plates 83, 84 in their adjusted positions. The upper edges of plates 83, 84 are provided with arcuate seats in which stub shafts 15, 16 are rotatably supported.

Stub shafts 15, 16 are axially aligned and extend in opposite directions from the ends of barrel 10. Sleeves 17, 18 on shafts 15, 16, respectively, space the ends of barrel 10 from arms 13, 14. Barrel 10 is rotated by reversible electric motor 19 whose output shaft 21, acting through adjustable length coupling 89, drives shaft 88 having bevel gear 22 keyed thereto. The latter is in driving engagement with bevel gear 23 that is keyed to shaft 16 outboard of arm 14. Barrel 10 is constructed of perforated tubular cylindrical side section 25 that is clamped between end plates 26, 27. Since the latter differ from each other only slightly in construction, for the sake of brevity, only the construction of end plate 26 shall be described in detail.

Figure 3:
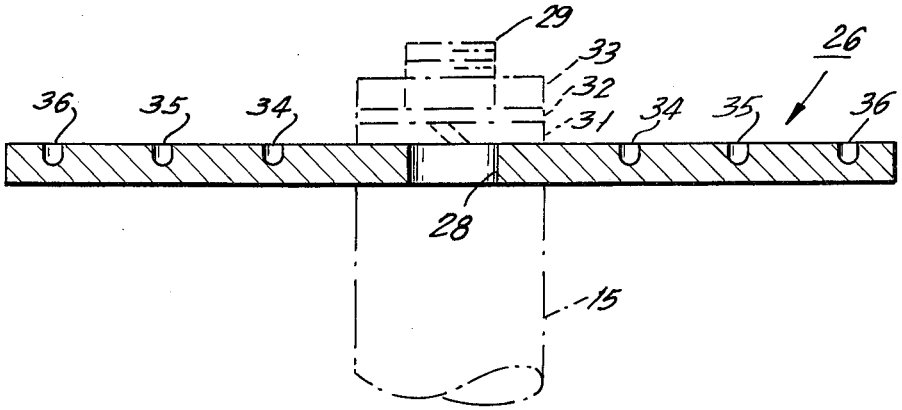
FIG. 3 is a cross-section of an end plate taken through line 3—3 of FIG. 2 looking in the direction of arrows 3—3.
Figure 4:
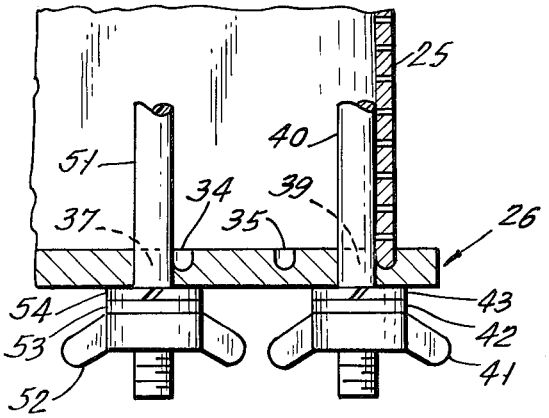
FIG. 4 is a fragmentary cross-section of an end plate taken through line 4—4 of FIG. 2 looking in the direction of arrows 4—4.

Plate 26 is a disk having central opening 28 through which the reduced diameter threaded section 29 at the inboard end of shaft 15 extends (FIG. 3) with lock washer 31, flat washer 32 and nut 33 being mounted on threaded section 29 for securing shaft 15 to plate 26. Three concentric circular grooves 34, 35, 36 are cut in the inboard face of plate 26 and adjacent each of the grooves 34, 35, 36 is a set of four tie rod receiving apertures. That is, sets of apertures 37, 38, 39 are disposed adjacent the respective grooves 34, 35, 36 on the inboard sides thereof. In plate 26 apertures 37–39 are unthreaded while corresponding holes in plate 27 are threaded.

Side section 25 is of a diameter that corresponds to the largest groove 36 and is seated at the bottom thereof. An individual tie rod 40, threaded at both ends, extends the full length of side section 25 and projects through each of the apertures 39 beyond the outboard surface end plate 26. The end of each tie rod 40 extending through plate 26 receives wing nut 41, flat washer 42 and lock washer 43. For each of the apertures 37, there is an individual buffer or scrubber rod 51, also threaded at both ends, that extends the full length of side section 25 and is provided at its end, that extends through plate 26 with wing nut 52 which bears against flat washer 53 that drives lock washer 54 against the outboard surfaces of end plate 26. The other ends of tie rods 40 and scrubber rods 51 are threadably received in the appropriately positioned apertures 39 and 37 of plate 27.

It should now be apparent to those skilled in the art that in accordance with the instant invention, the same end plates may be utilized to make a weldless connection with any of three different diameter perforated side sections. Stand 11 may be constructed without plates 83, 84 in which case arms 13, 14 will be provided with a plurality of bearing notches, preferably Teflon lined, each designed to rotatably support stub shafts 15, 16 at different heights.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A rotatable barrel for use in surface treatment of elements loaded therein, said barrel including first and second plates, a tubular side section having its opposite ends closed by the respective first and second plates, aligned shaft sections extending outwardly in opposite directions from said plates to define a rotational axis for said barrel, each of said plates further including plural positioning means to operatively position tubular side sections of different cross-sections concentric with said axis, said tubular side section being so positioned by one of said plural positioning means of each of said plates, and securing means for drawing said plates toward each other thereby clamping said side section between said plates.

2. A rotatable barrel as set forth in claim 1 in which the plural positioning means include a plurality of concentric grooves in said plates, each of said grooves proportioned to receive end portions of a side section having a cross-section of predetermined size and shape.

3. A rotatable barrel as set forth in claim 1 in which the securing means includes a plurality of tie rods that are disposed adjacent the inner surface of said side section and are positioned by apertures in said plates.

4. A rotatable barrel as set forth in claim 1 in which securement between said plates and said side section is achieved solely by clamping the latter between said plates.

5. A rotatable barrel as set forth in claim 1 in which the securing means includes a plurality of tie rods that extend through and are positioned by apertures through said plates.

6. A rotatable barrel for use in surface treatment of elements loaded therein, said barrel including first and second plates, a tubular side section having its opposite ends closed by the respective first and second plates, alighed shaft sections extending outward in opposite directions from said plates to define a rotational axis for said barrel, and securing means for drawing said plates toward each other thereby clamping said side section between said plates, said securing means including a plurality of tie rods that extend through and are positioned by apertures through said plates and each of said plates including a plurality of sets of tie rod positioning apertures, each of said sets being operatively positioned for use with a side section of particular cross-section.

7. A rotatable barrel as set forth in claim 6 also including buffing rods positioned inside said side section and extending parallel to said axis.

* * * * *